US005697442A

United States Patent [19]

Baldridge

[11] Patent Number: 5,697,442

[45] Date of Patent: Dec. 16, 1997

[54] APPARATUS AND METHODS FOR USE IN CEMENTING A CASING STRING WITHIN A WELL BORE

[75] Inventor: Morris G. Baldridge, Duncan, Okla.

[73] Assignee: Halliburton Company, Duncan, Okla.

[21] Appl. No.: 790,256

[22] Filed: Jan. 27, 1997

Related U.S. Application Data

[63] Continuation of Ser. No. 555,943, Nov. 13, 1995.

[51] Int. Cl.[6] ..... E21B 33/14

[52] U.S. Cl. ..... 166/286; 166/177.4; 166/222; 166/241.1; 166/242.8; 166/289; 166/327; 166/312

[58] Field of Search ..... 166/285, 286, 166/291, 241.1, 242.8, 327, 328, 222, 177.4, 312; 175/323, 394, 324

[56] References Cited

U.S. PATENT DOCUMENTS

| | | | |
|---|---|---|---|
| Re. 18,651 | 11/1932 | Little . | |
| 1,460,632 | 7/1923 | Wigle et al. . | |
| 1,786,761 | 12/1930 | Little . | |
| 1,998,833 | 4/1935 | Crowell | 166/1 |
| 2,253,415 | 8/1941 | Brodie | 166/1 |
| 2,295,803 | 9/1942 | O'Leary | 166/9 |
| 2,654,435 | 10/1953 | Oliver | 166/4 |
| 2,730,177 | 1/1956 | Kline | 166/184 |
| 2,762,441 | 9/1956 | Newlin | 166/186 |
| 4,712,619 | 12/1987 | Stepp et al. | 166/327 |
| 4,825,947 | 5/1989 | Mikolajczyk | 166/241 |
| 5,377,761 | 1/1995 | Kosar et al. | 166/222 X |

*Primary Examiner*—Hoang C. Dang
*Attorney, Agent, or Firm*—Craig W. Roddy

[57] ABSTRACT

The present invention provides an apparatus in the form of a float shoe or collar for use in cementing a casing string within a well bore. The shoe or collar has blades extending therefrom for centering the shoe or collar, as well as the lower end of the casing string, within the well bore. The blades include jetting ports positioned therein for use in jetting the formation. In an alternative embodiment, the jetting ports are located between blades which are generally convoluted and extend circumferentially part-way around the perimeter of the apparatus.

24 Claims, 8 Drawing Sheets

APPARATUS AND METHODS FOR USE IN CEMENTING A CASING STRING WITHIN A WELL BORE

This application is a continuation of copending application Ser. No. 08/555,943 filed on Nov. 13, 1995.

BACKGROUND

The present invention relates generally to apparatus and methods for use in cementing a casing string within a well bore. More particularly, to improvements in apparatus of this type known as "float collars" and "float shoes"

Float collars and shoes are of basically the same construction in that each is connectable as part of the casing string near (collars) or at (shoes) its lower end, and has valve means which permits flow downwardly but prevents flow upwardly through a vertical passageway. Typically, as it is lowered into the well bore, the casing string is filled with drilling mud to prevent its collapse due to pressure of the drilling mud already in the well bore. However, the string may not be filled completely so that, with the valve means closed, the drilling mud in the well bore has a buoyant effect to "float" the string in the well bore. In any event, when the string is lowered to total depth, pump pressure is applied to the string to open the valve means and thus to permit cement to be pumped through the string and into the annulus between the string and well bore.

Following addition of the desired volume of cement, a wiper plug is pumped down the string by means of mud or water until it bumps the float collar or lands on the float shoe. At this time, the pumps are shut off to permit the valve means to close and thus prevent cement from "U" tubing out of the annulus and back into the string before it hardens.

A conventional float collar or shoe comprises an outer tubular body having an upper threaded end for connection to a joint of casing thereabove, and valve means mounted within an inner body formed of concrete or other material which may be drilled out, when the cement is hardened, to fully open the casing string throughout its length.

The outer tubular body of a float shoe is threaded at only its upper end for connection to the lowermost joint of the casing string, and the lower end of the inner body of concrete extends below the lower end of the of the outer body and is rounded to guide the lower end of the string through the well bore. The outer body of a float collar is threaded at its lower and upper ends for connection as part of the casing string.

It is desirable to maintain the casing string centered within the well bore as cement is pumped upwardly within the annulus in order to provide a cement column of substantially uniform thickness. Thus, if the string is not centered, the column of cement may not completely surround it such that the well fluids may be free to channel or flow past the column. As a result, the cement column will not protect relatively weak shallow formations in the well bore from the heavier drilling muds used in drilling into deeper formations. Thus, upon drilling out the drillable inner body of the float shoe, the operator will drill a short distance into the well bore and pressure test to determine if the cement column will hold the heavier mud pressure. If it does not, the operator must perform a secondary cement squeeze until the column will hold the necessary pressure. This of course is a considerable expense which could be avoided if the initial cement column was adequate to hold the pressure.

Casing strings are therefore often centered in the well bore by so called "centralizers" which are connected a part of the casing string or disposed thereabout at desired intervals. For this purpose, centralizers have outwardly extending parts to engage the well bore, which parts have conventionally comprised bow springs extending lengthwise of the string and mounted at both ends to tightly engage the well bore, or metal strips welded to the body and bent to shapes which engage the well bore.

Float shoes and collars are known for use in cementing a casing string within a well bore wherein the shoe or collar includes blades extending along the outer side thereof for centering the shoe or collar, and thus, the lower end of the casing string, within the well bore. As a result, the float shoe, as the case may be, not only performs its ordinary function during the cementing operation, but, in addition holds the lower end of the casing string in a centralized position within the well bore.

In the rotary drilling operation, the mud is plastered against the bore wall so as to effectively bind the formation, but when it comes to cementing, this mud sheath is disadvantageous because it tends to prevent an effective bond between the cement and the bore wall which seriously compromises the integrity of the cement job.

Wherefore, it is desirable to have not only a centralized float collar or shoe but one which contains jetting ports for allowing the bore wall to be jetted before spotting the cement. The jetting action reduces the mud sheath buildup and removes filter cake in the shoe joint zone thereby reducing contamination of the cement plug. Hence, there is a need for an improved centralized float collar or shoe for jetting formations.

SUMMARY

The present invention provides an improved apparatus for cementing a casing string in a well bore which meets the needs described above and overcome the shortcomings of the prior art. The apparatus is in the form of a float shoe or float collar with blades extending therefrom for centering the shoe or collar, as well as the lower end of the casing string, within the well bore. The blades include jetting ports positioned therein for use in jetting the formation. In an alternative embodiment, the jetting ports are located between blades which are generally convoluted and extend circumferentially part-way around the perimeter of the apparatus.

A general object of the present invention is to provide improved apparatus for cementing casing string in a well bore.

Another object of the present invention to provide a float collar or shoe which has jetting ports located in centralizing blades extended therefrom.

It is a final object of the present invention to provide a float collar or shoe which has jetting ports interposed between centralizing blades that are generally convoluted and extend circumferentially part-way around the perimeter thereof.

BRIEF DESCRIPTION OF THE DRAWING

These and other features, aspects, and advantages of the present invention will become better understood with regard to the following description, appended claims, and accompanying drawings where:

DESCRIPTION

Figure 1:
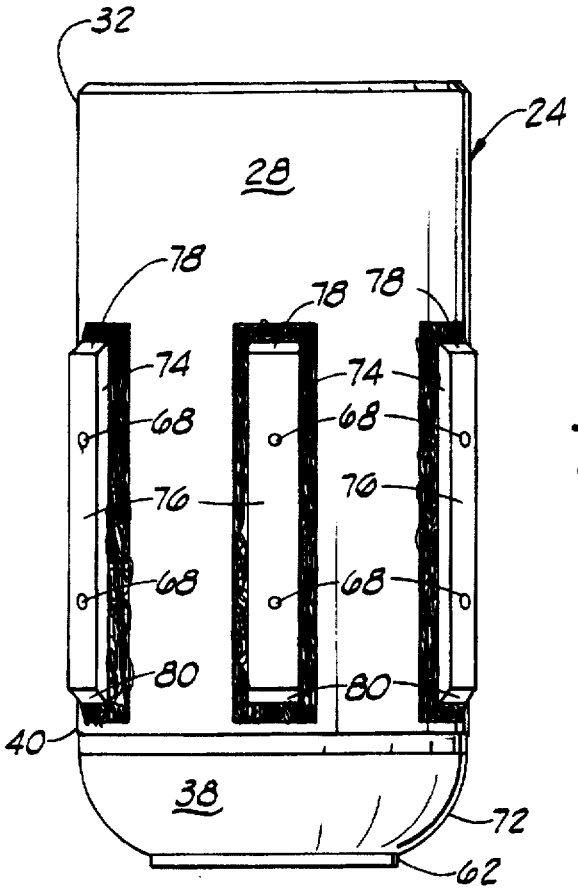
FIG. 1 is a front elevation view of a float shoe which has centralizing blades longitudinally extended therefrom, wherein jetting ports are positioned in the blades.
Figure 2:
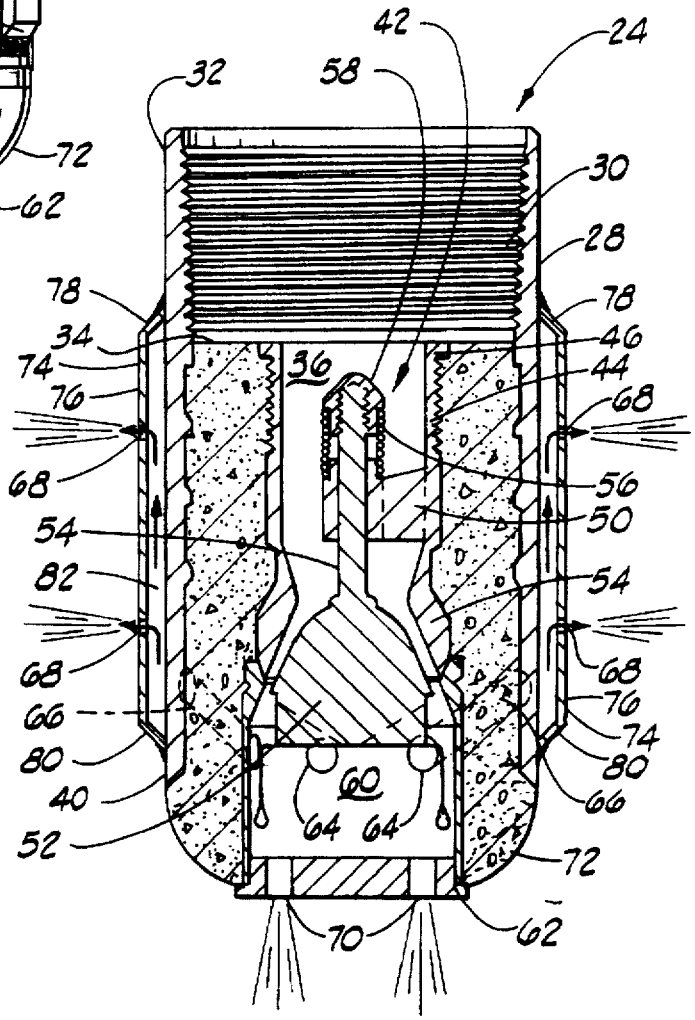
FIG. 2 is a section view of FIG. 1.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

As illustrated in FIGS. 1–16, the present embodiment of the invention relates generally to apparatus for use in cementing a casing string 20 in a well bore 22. The apparatus may be designed as either a float shoe 24 or a float collar 26. Alternatively, the float collar 26 may be designed as a non-floating collar 26 as shown in FIGS. 4–8.

The float shoe 24 includes a tubular outer body 28 having female threads 30 about the inner diameter of its upper end 32 for connection with a lower end of a joint of casing at the lower end of the casing string 20. Preferably, the outer body 28 is made of the same grade of steel as the casing string 20, thereby maintaining the strength and integrity of the string 20 throughout its entire length.

The float shoe 24 also comprises an inner body 34 having a passageway 36 and including a body 38 of concrete or other drillable material disposed about the inner diameter of the outer body 28 beneath the threads 30 of the upper end 32 and extending below a lower end 40 of the outer body 28. In addition, a popper valve assembly 42 is securably mounted within the float shoe 24 as part of the inner body 34 to control the flow of liquid through the passageway 36. The preferred valve assembly 42 is shown and described in U.S. Pat. No. 4,712,619 which is incorporated herein by reference. Further, the preferred valve assembly 42 is available from Halliburton Energy Services, Duncan, Okla., under the tradename "SUPER SEAL™II"

The popper valve assembly 42 comprises a tubular body 44 having flange means 46 on the exterior thereof, and a downward-facing valve seat 48 at the bottom interior thereof, with a valve guide spider 50 thereabove. A dome-shaped poppet valve 52 seats on the aforesaid valve seat 48, and has coaxially secured thereto an upwardly extending stem bolt 54 which protrudes through and above the valve guide spider 50. A spring 56 disposed about the stem bolt 54 biases it upwardly, acting on the top surface of the spider 50 and on a lower surface of a spring retention cap 58 secured to the top of the stem bolt 54. In such a manner, the poppet valve 52 is biased into engagement with the valve seat 48 at the lower end of the valve assembly 42.

Mounted below the valve assembly 42 is an adapter 60 and baffle 62, wherein the adapter 60 includes a plurality of apertures 64 for providing fluid communication between the passageway 36 and fluid passages 66 which preferably extend upwardly through the apparatus to the outer diameter of the outer body 28. The baffle 62 forces a portion of the fluid received in the shoe 24 to be jetted through side jetting ports 68 while the remaining fluid is jetted through openings 70 in the baffle 62, and thus, from the lower end of the shoe 24. The adapter 60 and baffle 62 are available from Halliburton Energy Services, Duncan, Okla., under part numbers 837.06852 and 837.06853, respectively.

As is known in the art of float shoes and collars of this general construction, when the casing string 20 has been lowered to full depth and the cement pumps are turned on, cement may be circulated downwardly through the casing string 20 to open the valve assembly 42 and permit the cement to flow therethrough, and thus, out the lower end of the shoe 24 or collar 26 and upwardly within the annulus between the casing string 20 and the well bore 22. Then, when the desired volume of cement has been pumped into the annulus, and the mud pumps are turned off, the hydrostatic pressure of the cement will force the valve assembly 42 closed, thus preventing the cement column from "U" tubing up into the casing string 20.

After the cement has hardened within the annulus, a suitable drilling tool may be lowered through the casing string 20 to drill out the body 38 of concrete and thus open the lower end of the string 20 to full bore, as well as drill deeper into the well bore 22. In this way, the operator may pressure test the cement column before drilling into deeper formations. Or, if desired, the cemented casing string 20 may be perforated for completion purposes.

As previously noted, a lower end of the concrete body 38 extends beneath the lower end 40 of the outer body 28, and is rounded so as to provide a nose 72 which assists in guiding the casing string 20 through obstructions which might exist in the well bore 22. Also, the fluid passages 66 are formed through the outer body 28 as well as the inner body 34 to connect the passageway 36 with the outer diameter of the shoe 24. Hence, the fluid is delivered from the jetting ports 68 for jetting or washing the formation.

In accordance with the present invention, a plurality of blades 74 extend along the outside of the outer body 28 so as to center the float shoe 24, and thus the lower end of the casing string 20, within the well bore 22. The blades 74 are of such radial extent that their outer edges 76 are adapted to lie close to the well bore 22. As shown, the blades 74 are relatively thick to provide relatively wide surfaces along their outer edges 76. Also, their upper and lower ends 78, 80 may taper inwardly so as to assist in guiding the shoe into and out of the well bore 22. Preferably, the blades 74 are equally spaced apart about the circumference of the outer body 28.

More particularly, in a preferred embodiment of the invention as shown in FIGS. 1–8, each blade 74 has a hollow cavity 82 defined therein, and one or more of the jetting ports 68 located on a radial face portion thereof. As shown, the hollow cavity 82 within one blade 74 may provide fluid passage with a plurality of jetting ports 68 within the same blade 74. Hence, when the valve assembly 42 is open, fluid communication exists between the passageway 36 and jetting ports 68, by means of the fluid passages 66 and cavities 82.

Figure 3:
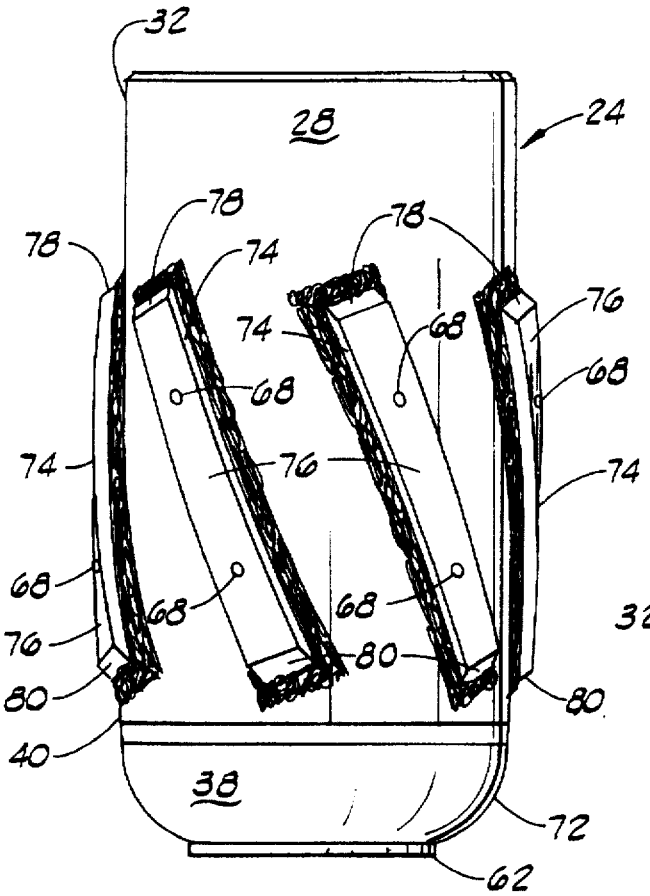
FIG. 3 is a front elevation view of a float shoe which has generally convoluted centralizing blades extended circumferentially part-way around the perimeter thereof, wherein jetting ports are positioned in the blades.
Figure 4:
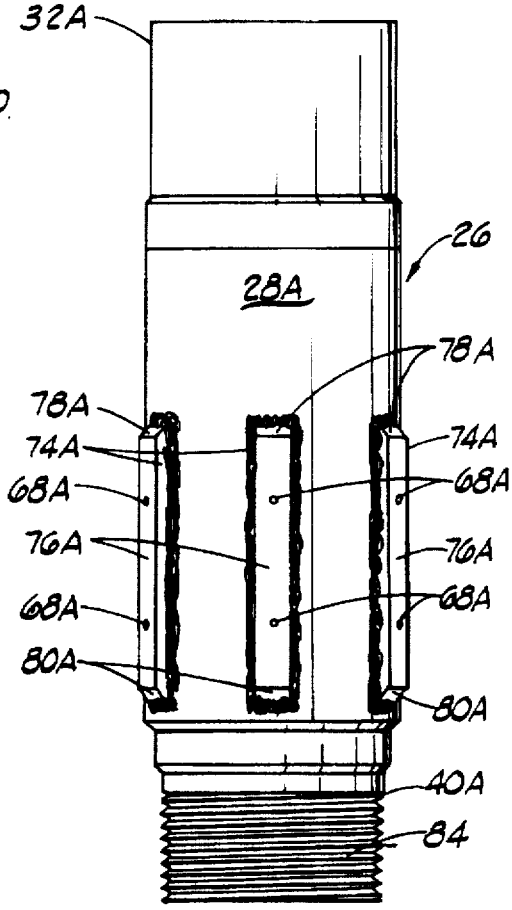
FIG. 4 is a front elevation view of a collar which has centralizing blades longitudinally extended therefrom, wherein jetting ports are positioned in the blades.
Figure 8:
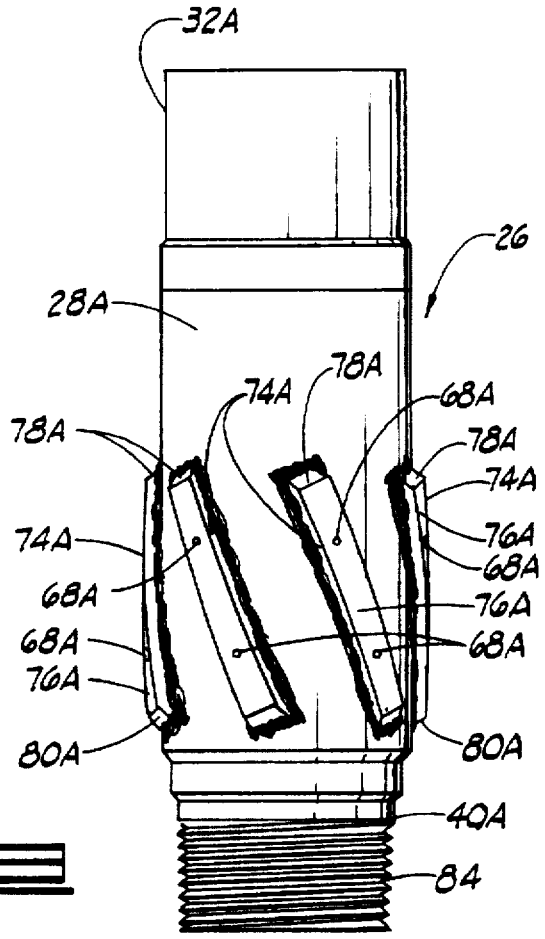
FIG. 8 is a front elevation view of a collar which has generally convoluted centralizing blades extended circumferentially part-way around the perimeter thereof, wherein jetting ports are positioned in the blades.
Figure 9:
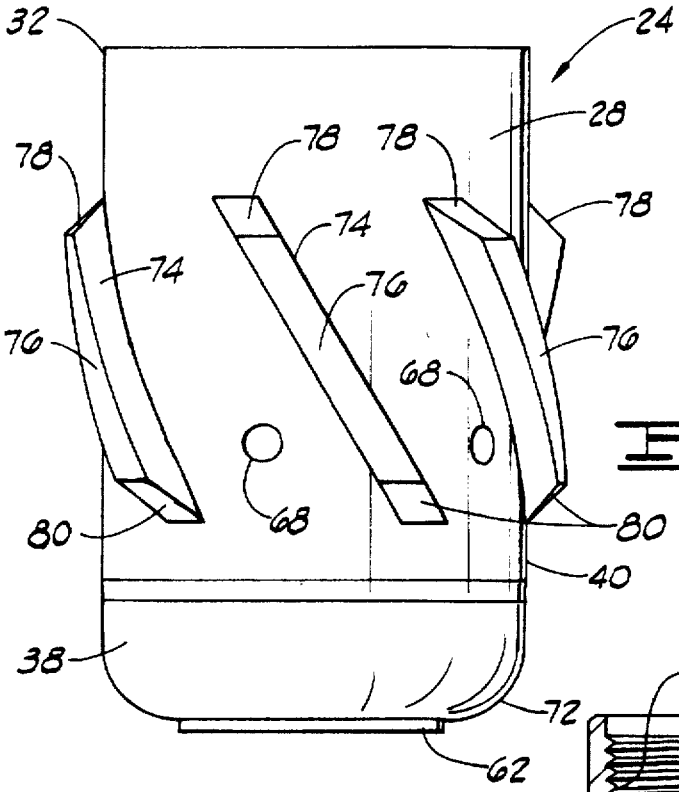
FIG. 9 is a front elevation view of a float shoe which has generally convoluted centralizing blades extended circumferentially part-way around the perimeter thereof, wherein jetting ports are positioned between the blades.
Figure 10:
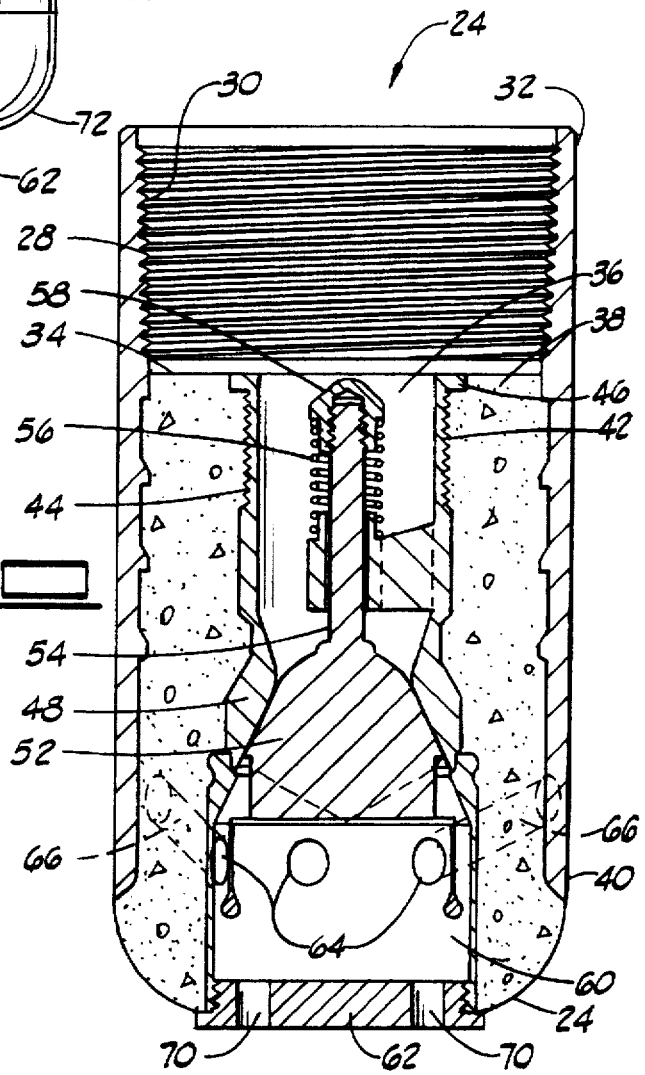
FIG. 10 is a section view of FIG. 9.
Figure 11:
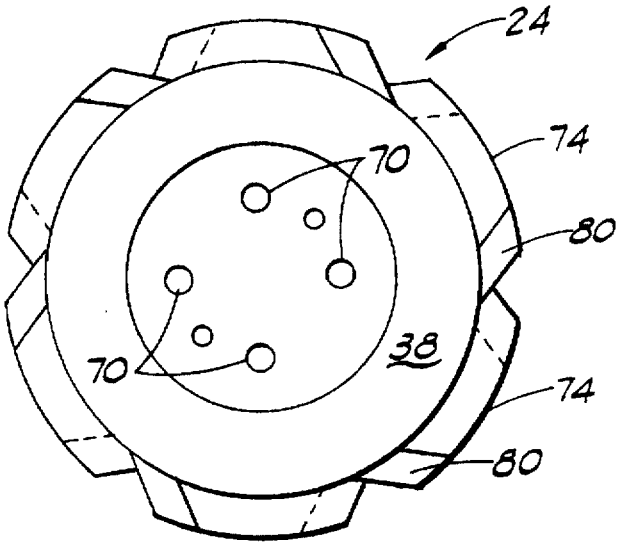
FIG. 11 is a bottom plan view of FIG. 9.

Preferably, the jetting ports 68 are positioned on the radial face portion of the blades 74 such that the jetting fluid is delivered in close proximity to the wall of the well bore 22, and thus, providing a more efficient and effective means of washing the formation. The blades 74 may be positioned longitudinally along the outer body 28 as shown in FIGS. 1 and 4, or alternatively, each blade 74 is generally convoluted about the longitudinal axis and extends circumferentially part-way around the perimeter of said outer body 28 as shown in FIGS. 3 and 8.

Another embodiment of the invention, as shown in FIGS. 9–13, includes having the jetting ports 68 located between the blades 74. This particular embodiment includes each blade 74 being generally convoluted and extended circumferentially part-way around the perimeter of said outer body 28.

The blades 74 of each embodiment may be formed integrally with the outer body 28 or separately produced and attached therewith by welding or other suitable means of attaching known in the art.

The collar 26 constructed in accordance with the present versions of invention is of similar construction to the float shoe 24, as indicated by the use of the same number to designate like parts except for the addition of the suffix "A". Thus, the collar 26 includes an outer body 28A having threads 30A about its upper end 32A for connection to a lower end of a joint of casing string 20 thereabove. However, as compared with the float shoe 24, the outer body 28A has additional threads 84 on its lower end 40A for connection with an upper end of a lower joint of the casing string 20. Thus, the collar 26 is not at the lower end of the casing string 20, but instead is connected at least one joint of casing above its lower end.

Figure 5:
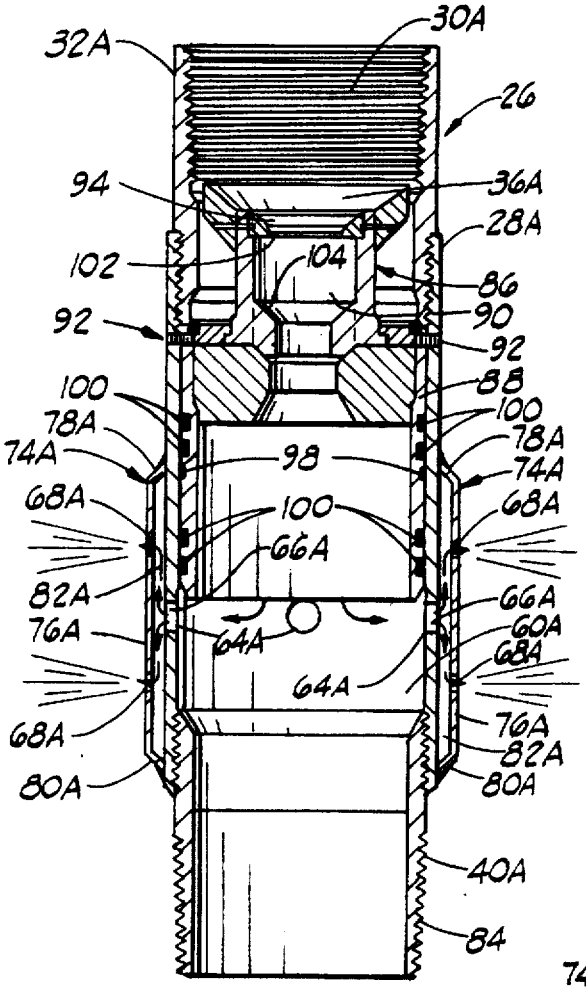
FIG. 5 is a section view of FIG. 4, wherein fluid communication is open between the casing string and jetting ports.
Figure 6:
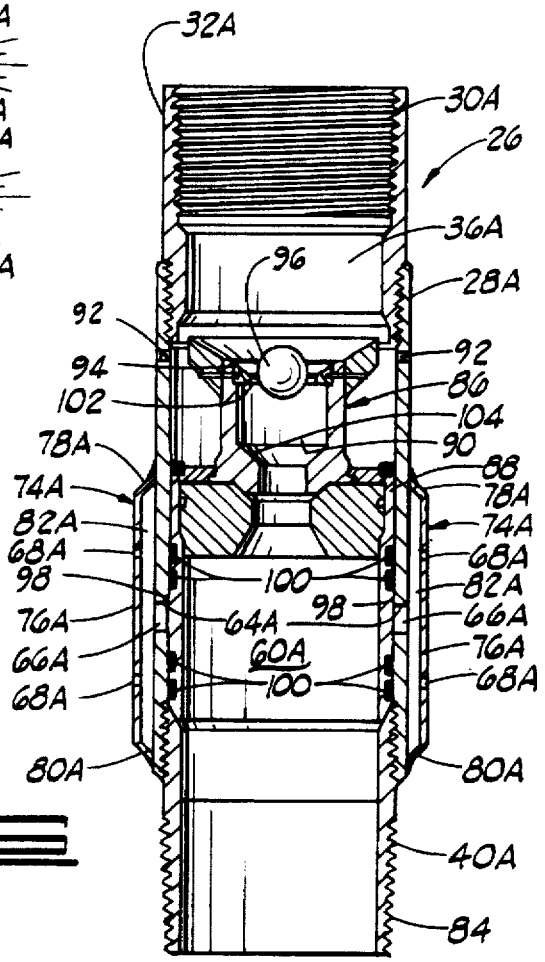
FIG. 6 is a section view of FIG. 4, wherein the fluid communication between the casing string and jetting ports is closed by the sliding sleeve.
Figure 7:
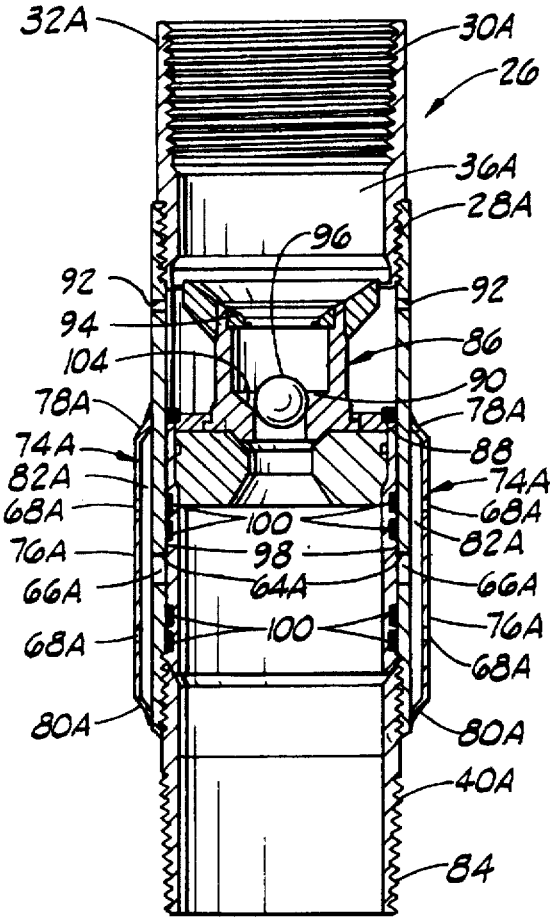
FIG. 7 is a section view of FIG. 4, wherein the ball is landed on a lower landing portion to allow fluid passage through the collar.

Additionally, as shown in FIGS. 5–7, the collar 26 includes a ball activated valve 86 with the passageway 36A extended therethrough. A tubular sliding sleeve 88 is received within the outer body 28A for closing off the fluid communication which exists between the passageway 36A and jetting ports 68A, wherein the sleeve 88 is threadably connected with a cage 90. The sleeve 88 and attached cage 90 are held in the open position (i.e., allowing fluid communication between the casing string 20 and jetting ports 68A) using conventional shear pins 92.

The cage 90 includes an upper landing portion 94 for receiving an activation ball 96 thereon. Thus, after the formation has been washed and the ball 96 lands on the upper landing position 94, pressure is applied thereto in order to shear the pins 92 and slide the sleeve 88 downward for covering the fluid passages 66A. Hence, fluid communication is closed between the passageway 36A and jetting ports 68A. A lock ring and groove means 98 is provided for locking the sliding sleeve 88 in the closed or downward position. In addition, when the sleeve 88 is in the closed position, seals 100 located on the outer diameter thereof are positioned above and below the fluid passages 66A.

After the sleeve 88 is locked in the closed position, additional pressure is applied to the ball 96 thereby forcing it through a metal shear ring 102 on which it is seated in the upper landing portion 94. Hence, the ball 96 is released through the upper landing portion 94 and is allowed to fall onto a lower landing portion 104 which allows fluid to pass through the collar 26 and downwardly through the casing string 20. Further, as shown in FIG. 13, the collar 26 may also incorporate the poppet valve assembly 42A for regulating the flow of fluids therethrough.

Figure 12:
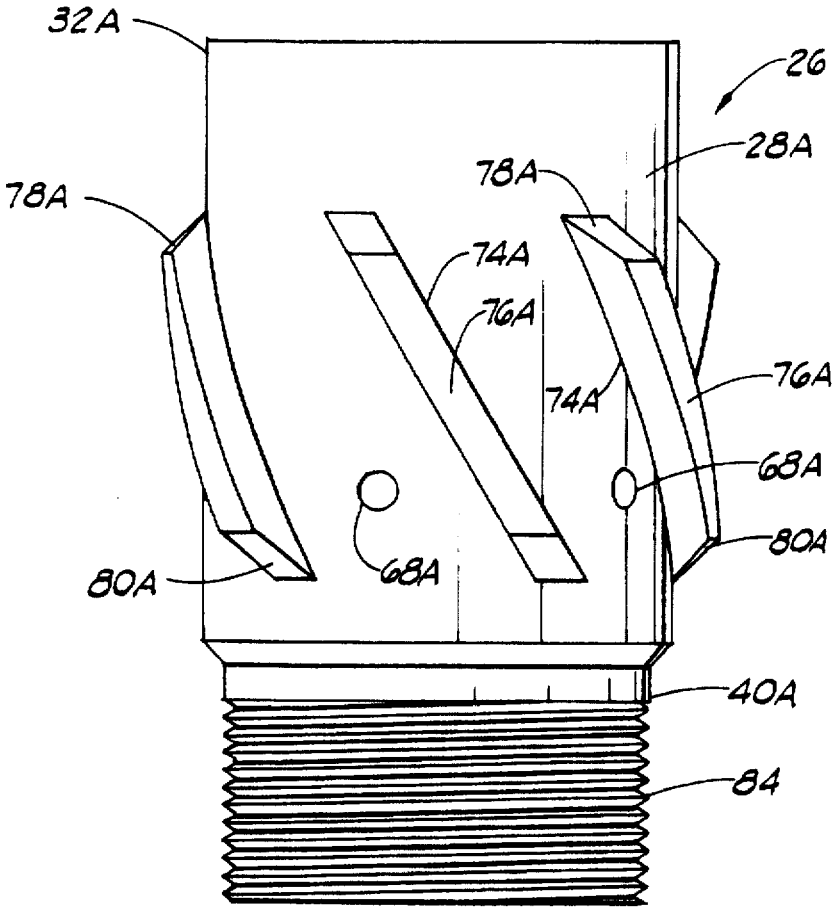
FIG. 12 is a front elevation view of a float collar which has generally convoluted centralizing blades extended circumferentially part-way around the perimeter thereof, wherein jetting ports are positioned between the blades.
Figure 13:
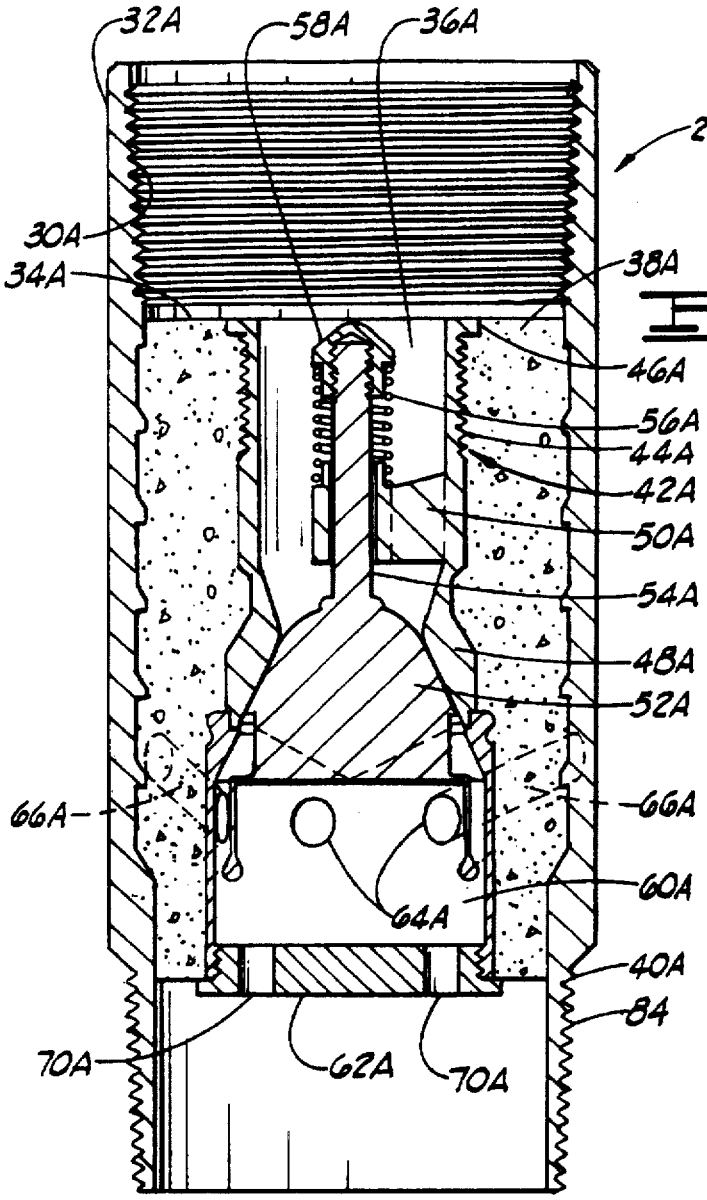
FIG. 13 is a section view of FIG. 12.
Figure 14:
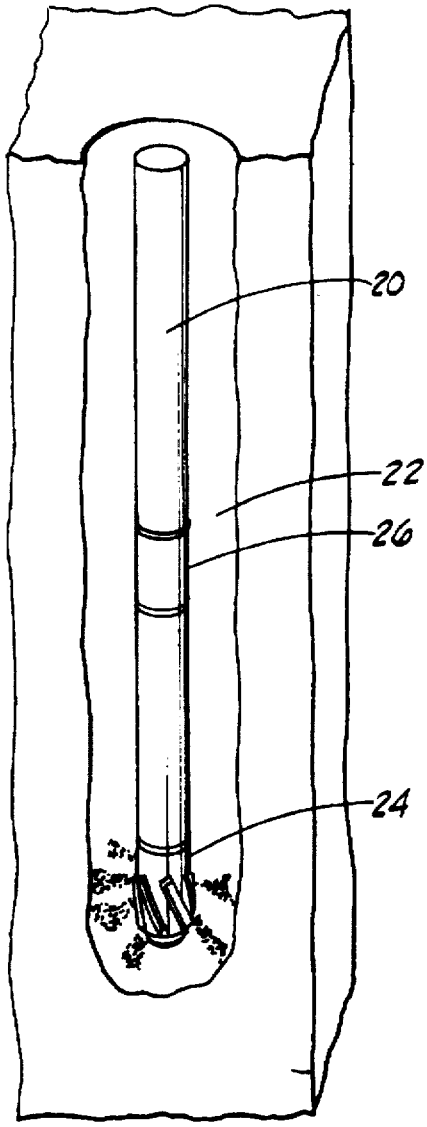
FIG. 14 illustrates using a float shoe of the present invention to wash a formation.
Figure 15:
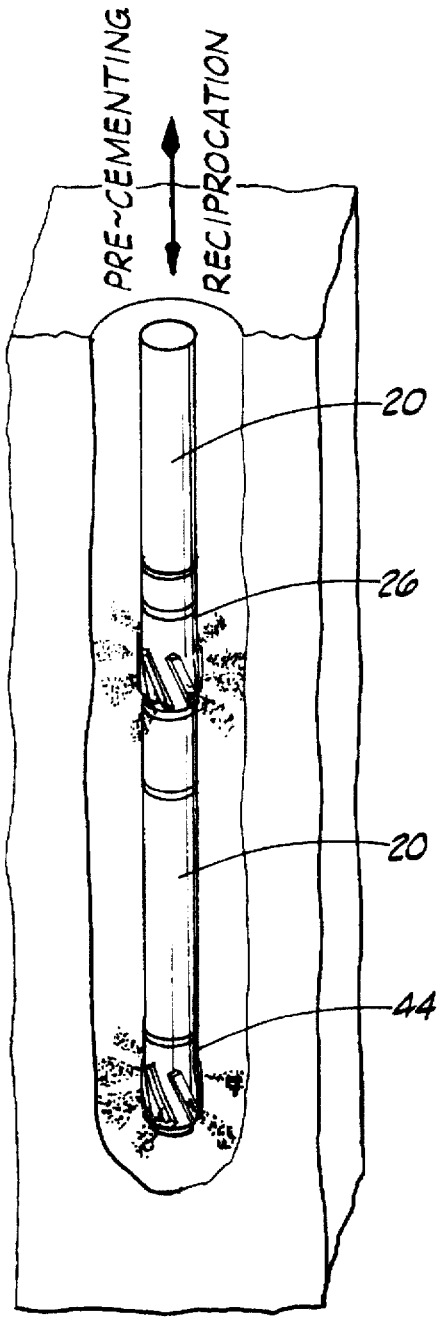
FIG. 15 illustrates using a collar and float shoe of the present invention to wash a formation.
Figure 16:
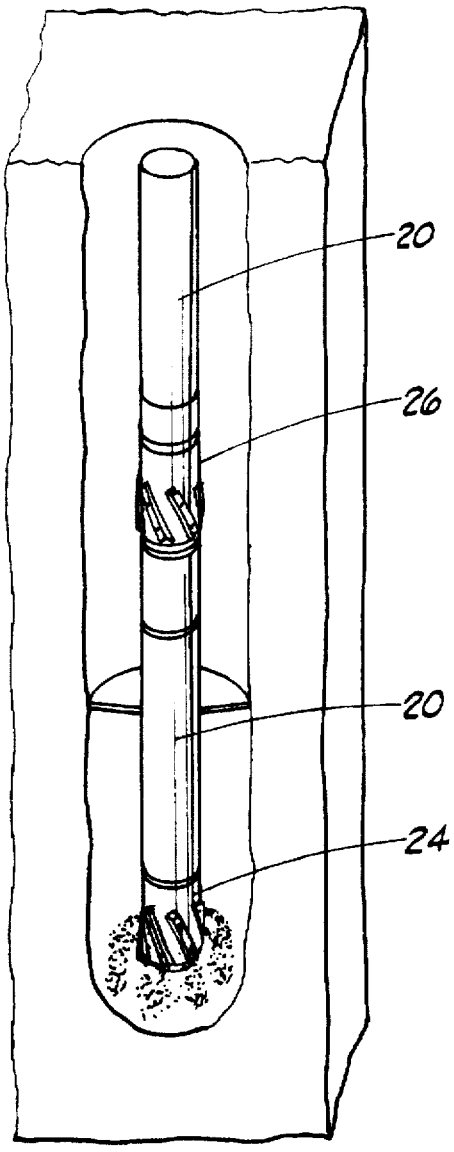
FIG. 16 illustrates using a collar in the closed position and a float shoe of the present invention to cement a formation.

As will be apparent from the reference characters appearing on FIGS. 12 and 13, the other parts of the float collar 26 making up its basic construction are similar to those making up the basic construction of the float shoe 24. It will also be understood that, as previously described, the float collar 26 functions in substantially the same way as the float shoe 24 as the casing string 20 is lowered to total depth within the well bore 22, and fluid is jetted therefrom to wash the well bore 22. As in the case of the float shoe 24, the concrete body 38A or other drillable material of the float collar 26 may be removed after the cement column has hardened so as to open the casing string 20 to full bore. Also, since the collar 26 is not disposed at the lower end of the casing string 20, and thus does not have to guide the casing string 20 into the well bore 22, the lower end of the concrete body 38A need not extend below the lower end 40A of the outer body 28A, see FIG. 13.

A preferred method of cementing the casing string 20 within the well bore 22 includes attaching the float shoe 24 and/or float collar 26 of the present invention to the casing string 20 and using the shoe 24 and/or collar 26 to jet the formation. The float shoe 24 and collar 26 of the present invention are advantageous in providing improved apparatus for jetting the well bore 22 prior to cementing, and for delivering cement within the well bore 22 to effectively cement the casing string 20 therein.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A method of cementing a casing string within a well bore comprising the steps of:

attaching an apparatus to the casing string wherein the apparatus includes:

(a) an outer body having means for connection ,as part of the casing string;

(b) a blade extended from said outer body, said blade having a plurality of jetting ports; and (c) means for providing fluid communication between the casing string and said jetting ports; and delivering a cementing fluid through said jetting ports and into the well bore to cement the casing spring therein.

2. The method as recited in claim 1 wherein said ports are located on a radial face portion of said blade.

3. The method as recited in claim 1 wherein said means for providing fluid communication includes said blade having a cavity defined therein.

4. The method as recited in claim 1 wherein said blade extends longitudinally along the perimeter of said outer body.

5. The method as recited in claim 1 wherein said blade is generally convoluted and extends circumferentially partway around the perimeter of said outer body.

6. The method as recited in claim 1 further comprising the step of using the apparatus to jet a wall of the well bore.

7. A method of cementing a casing string within a well bore comprising the steps of:

attaching an apparatus to the casing string wherein the apparatus includes:

(a) an outer body having means for connection as part of the casing string;

(b) a blade extended from said outer body, said blade having a jetting port located on a radial face portion thereof; and (c) means for providing fluid communication between the casing string and said jetting port; and delivering á cementing fluid through said jetting port and into the well bore to cement the casing string therein.

8. The method as recited in claims 7 wherein said blade has a plurality of jetting ports located on a radial face portion thereof.

9. The method as recited in claim 7 wherein said means for providing fluid communication includes said blade having a cavity defined therein.

10. The method as recited in claim 7 wherein said blade extends longitudinally along the perimeter of said outer body.

11. The method as recited in claim 7 wherein said blade is generally convoluted and extends circumferentially partway around the perimeter of said outer body.

12. The method as recited in claims 7 further comprising the step of using the apparatus to jet a wall of the well bore.

13. A method of cementing a casing string within a well bore comprising the steps of:

attaching a float shoe to the casing string wherein the float shoe includes:

(a) an outer body having means for connection as part of the casing strings (b) a blade extended from said outer body, said blade having a port; and (c) means for providing fluid communication between the casing string and said port; and delivering a cementing fluid through said port and into the well bore to cement the casing string therein.

14. The method as recited in claim 13 wherein said port is located on a radial face portion of said blade.

15. The method as recited in claim 13 wherein said means for providing fluid communication includes said blade having a cavity defined therein.

16. The method as recited in claim 13 wherein said blade extends longitudinally along the perimeter of said outer body.

17. The method as recited in claim 13 wherein said blade is generally convoluted and extends circumferentially partway around the perimeter of said outer body.

18. The method as recited in claim 13 further comprising the step of using the float shoe to jet a wall of the well bore.

19. A float shoe for use in a well bore comprising:

an outer body having means for connection as part of a casing string;

a blade extended from said outer body, said blade having a port for delivering a fluid into the well bore;

means for providing fluid communication between the casing string and said port; and valve means in said outer body for allowing downward flow but preventing upward flow therethrough.

20. The float shoe as recited in claim 19 wherein said blade includes a plurality of ports.

21. The float shoe as recited in claim 19 wherein the port is located on a radial face portion of said blade.

22. The float shoe as recited in claim 19 wherein said means for providing fluid communication includes said blade having a cavity defined therein.

23. The float shoe as recited in claim 19 wherein said blade extends longitudinally along the perimeter of said outer body.

24. The float shoe as recited in claim 19 wherein said blade is generally convoluted and extends circumferentially part-way around the perimeter of said outer body.

* * * * *